US005622340A

United States Patent [19]

Turner et al.

[11] Patent Number: 5,622,340

[45] Date of Patent: *Apr. 22, 1997

[54] RAIL SWITCH POINT ASSIST APPARATUS

[75] Inventors: Charles W. Turner, Omaha, Nebr.; Michael K. Flaherty, Palatine, Ill.

[73] Assignee: Double T Railroad Products, Omaha, Nebr.

[ * ] Notice: The term of this patent shall not extend beyond the expiration date of Pat. No. 5,482,231.

[21] Appl. No.: 566,835

[22] Filed: Dec. 4, 1995

Related U.S. Application Data

[63] Continuation of Ser. No. 254,924, Jun. 7, 1994, Pat. No. 5,482,231.

[51] Int. Cl.[6] ..... E01B 7/00

[52] U.S. Cl. ..... 246/415 R; 246/453

[58] Field of Search ..... 246/415 R, 430, 246/433, 435 R, 442, 445, 449, 450, 451, 452, 453

[56] References Cited

U.S. PATENT DOCUMENTS

| | | | |
|---|---|---|---|
| 224,157 | 2/1880 | Donkersley | 246/430 |
| 1,758,637 | 5/1930 | Wynn-Williams | 246/453 |
| 2,533,929 | 12/1950 | Gray et al. | 246/453 |
| 4,105,175 | 8/1978 | DeSpiegeleer | 246/430 |
| 4,890,804 | 1/1990 | Teramoto et al. | 246/453 |
| 5,127,613 | 7/1992 | Germann | 246/453 |
| 5,482,231 | 1/1996 | Turner et al. | 246/453 |

FOREIGN PATENT DOCUMENTS

| | | | |
|---|---|---|---|
| 0389851 | 10/1990 | European Pat. Off. | 246/453 |
| 2423584 | 11/1979 | France . | |
| 1056641 | 2/1957 | Germany | 246/453 |
| 4223095 | 1/1994 | Germany | 246/453 |
| 325977 | 3/1930 | United Kingdom | 246/453 |

*Primary Examiner*—S. Joseph Morano
*Attorney, Agent, or Firm*—Zarley, McKee, Thomte Voorhees & Sease; Mark D. Frederiksen

[57] ABSTRACT

A rail switch point assist apparatus includes an elongated main member having an outward end removably and adjustably connected to the railroad track running rail and the inner end adjustably connected to a support member extending between a pair of ties. The inward end of the main member is vertically adjustable relative to the support member, and a pair of rollers are rotatably mounted between the inward end and the track running rail. The rollers are mounted on the main member to support a rail switch point moving towards and after from the track running rail. The outward end of the main member includes a bracket which is pivotally and slidably mounted to the main member so as to pivot about an axis transverse to the longitudinal axis of the main member and being slidable along the longitudinal axis of the main member.

2 Claims, 3 Drawing Sheets

RAIL SWITCH POINT ASSIST APPARATUS

CROSS-REFERENCE TO RELATED APPLICATION

This is a continuation application of Ser. No. 08/254,924 filed Jun. 7, 1994, now U.S. Pat. No. 5,482,231.

TECHNICAL FIELD

The present invention relates generally to railroad switches, and more particularly to an improved apparatus for assisting in the movement of a switch point.

BACKGROUND OF THE INVENTION

A railroad turnout or switch is operable to move a pair of "switch rails" or "switch points" transversely into contact with adjacent main rails, so as to direct a train along either the main track or an adjacent siding track. Although the distance which the switch points move is quite small, the steel rail is quite heavy, and requires a large amount of force to shift the switch points as necessary.

Conventionally, switch points slide over bearings or bearing plates, supported by sleepers or ties. In order to insure smooth sliding of the switch point, this base plate is preferably well lubricated.

In order to eliminate the periodic application of lubricating fluid on the base plate, attempts have been made to provide a reduced friction surface on the base plate over which the switch points will slide. One example is disclosed in U.S. Pat. No. 4,890,804 to Teramoto et al., wherein a sprayed coated ceramic layer is formed on the base plate.

U.S. Pat. No. 4,105,175 to De Spiegeleer discloses a bearing plate with a self-lubricating sliding surface. More recently, U.S. Pat. No. 5,127,613 discloses an antifriction insert introduced on a base plate for supporting switch points. While the above-described devices improve the sliding of the switch point on the base plate, they still suffer several drawbacks. First, prior art switch point bearing surfaces are typically not easily attached or removed from the railroad track, thereby increasing the amount of time and effort required to install such devices at switches, and increasing the cost to install such devices.

In addition, most prior art devices are not adjustable so as to "fine tune" the switch point bearing device for the particular conditions and orientation of the ties and switch points adjacent the main rail. Thus, the wear plate can receive uneven wear from movement of the switch point and decrease the use for life of the wear plate.

Finally, prior art switch point movement assisting devices typically include complicated structure having numerous parts which are not easily replaceable or repairable.

SUMMARY OF THE INVENTION

It is therefore a general object of the present invention to provide an improved switch point assist apparatus.

Another object of the present invention is to provide a switch point assist apparatus which is quickly and simply installed or removed from a section of track.

Yet another object is to provide a switch point assist which is adjustable to the specific site conditions of the track.

Yet another object of the present invention is to provide a switch point assist apparatus which is simple in construction, economical to manufacture, and which utilizes easily replaceable parts.

These and other objects will be apparent to those skilled in the art.

The rail switch point assist apparatus of the present invention includes an elongated main member having an outward end removably and adjustably connected to the railroad track running rail and the inner end adjustably connected to a support member extending between a pair of ties. The inward end of the main member is vertically adjustable relative to the support member, and a pair of rollers are rotatably mounted between the inward end and the track running rail. The rollers are mounted on the main member to support a rail switch point moving towards and after from the track running rail. The outward end of the main member includes a bracket which is pivotally and slidably mounted to the main member so as to pivot about an axis transverse to the longitudinal axis of the main member and being slidable along the longitudinal axis of the main member.

DESCRIPTION OF THE PREFERRED EMBODIMENT

Figure 1:
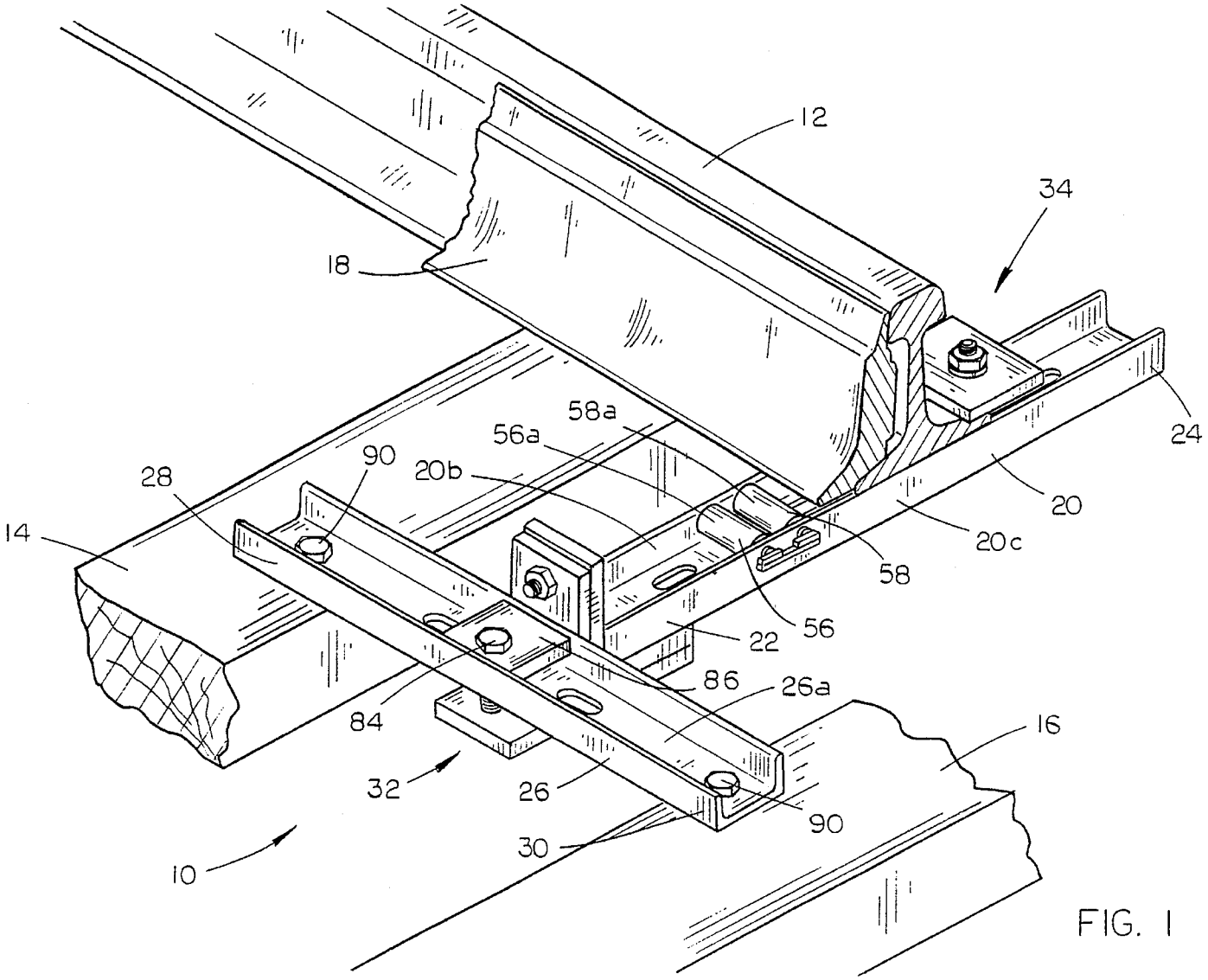
FIG. 1 is a perspective view of the present invention installed on a railroad switch.

Referring now to the drawings, in which similar or corresponding parts are identified with the same reference numeral, and more particularly to FIG. 1, the switch point assist apparatus of the present invention is designated generally at 10 and is shown connected to a main rail or "running rail" 12 of a railroad track, and between a pair of ties 14 and 16, to support a switch rail or "switch point" 18 during movement of the switch point.

Switch point assist apparatus 10 includes an elongated main channel 20 having inner and outer ends 22 and 24 respectively, with the outer end 24 operably connected to running rail 12 as described in more detail hereinbelow. The inner end 22 of main channel 20 is adjustably connected to an elongated support member 26, which is also preferably in the form of an elongated rigid channel having forward and rearward ends 28 and 30 respectively. As shown in FIG. 1, forward end 28 of channel 26 is mounted to the upper surface of tie 14, while rearward end 30 is mounted to the upper surface of tie 16, such that support member 26 supports the inner end 22 of main channel 20 within the space between ties 14 and 16. An adjustment mechanism is designated generally at 32 and interconnects inner end 22 of main channel 20 with support member 26. A clamp apparatus is designed generally at 34, and removably connects the outer end 24 of main channel 20 with running rail 12.

Figure 2:
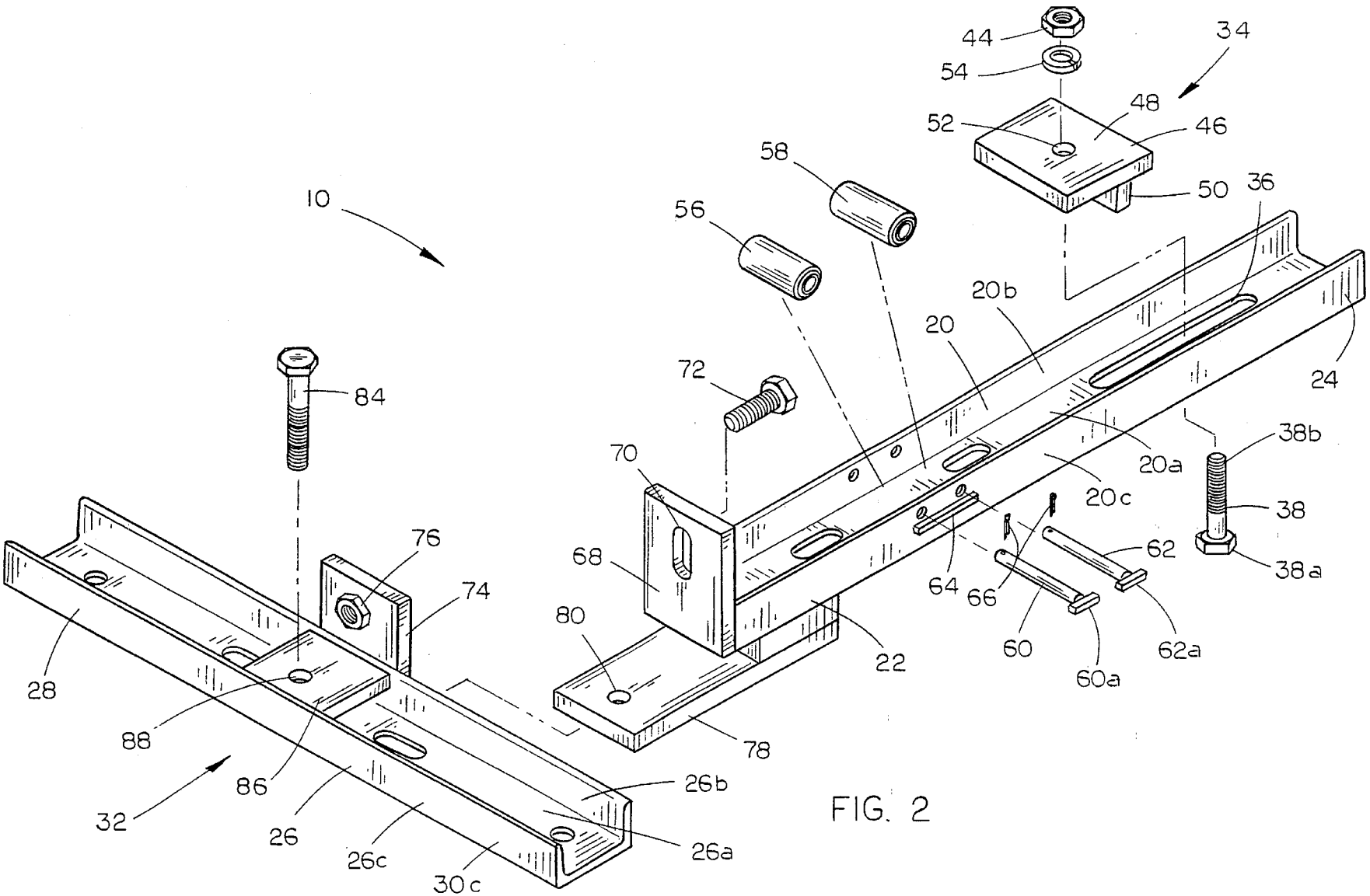
FIG. 2 is an exploded perspective view of the switch point assist apparatus of the present invention.
Figure 5:
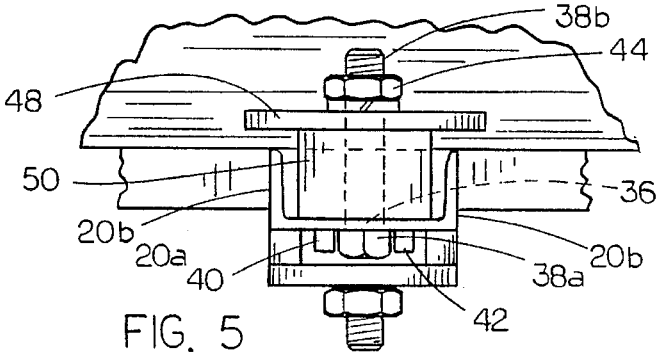
FIG. 5 is an enlarged end elevational view taken at lines 5—5 in FIG. 4.

Referring now to FIG. 2, the switch point assist apparatus 10 of the present invention is shown in exploded perspective view. Channel 20 opens upwardly, and includes a generally horizontal base portion 20*a* and a pair of spaced-apart vertical side walls 20*b* and 20*c*. A slot 36 is formed in the outer end 24 of base 20*a*, and extends longitudinally along channel base 20*a*. Clamp apparatus 34 includes a bolt 38 having a conventional polygonal head 38*a* and a threaded shank 38*b*. Shank 38*b* extends upwardly through slot 36 to project therefrom with head 38*a* disposed against the bottom of channel base 20*a*, as shown in FIG. 5. A pair of elongated guide members 40 and 42 are affixed to the bottom of channel 20*a* in parallel spaced-apart orientation on opposite sides of slot 36, to permit bolt head 38*a* to slide along slot 36 without rotating along the longitudinal axis of bolt 38. In this way, nut 44 may be threaded on shank 38*b* without requiring a tool to hold head 38*a* from rotating.

Referring again to FIG. 2, clamp apparatus 34 includes a bracket 46 having a generally horizontal plate 48 affixed to the upper end of a pivot leg 50 to form an inverted L-shaped member. As shown in FIG. 5, pivot leg 50 has a width greater than slot 36 and less than the distance between side walls 20*b* of channel 20, such that pivot leg 50 fits within channel 20. Bolt 38 extends upwardly through slot 36 and channel 20 and thence through an aperture 52 generally centered in plate 48, so as to receive a lock washer 54 and nut 44 on threaded end 38*b*.

Figure 4:
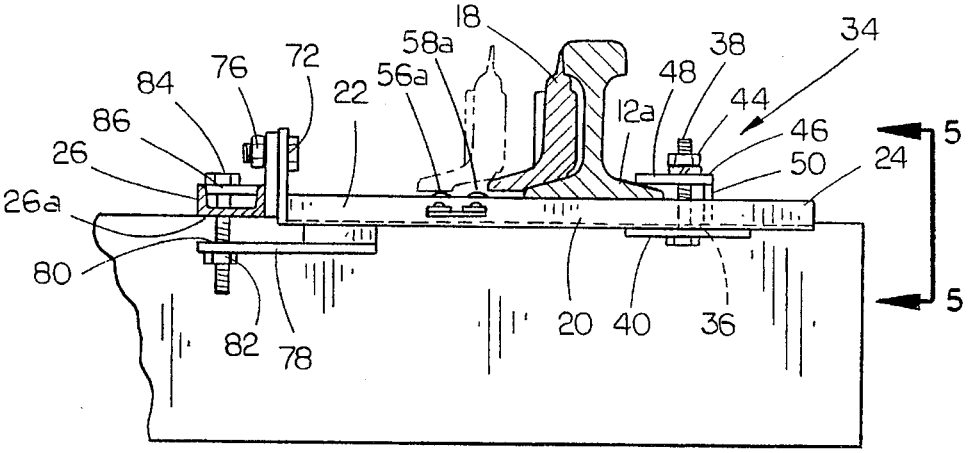
FIG. 4 is a sectional view taken at lines 4—4 in FIG. 3.

As shown in FIG. 4, bracket 46 will slide within channel 20 and pivot about the lower edge of pivot leg 50 such that the free end of plate 48 will engage the projecting foot 12*a* of running rail 12. Tightening nut 44 on bolt 38 will tighten clamp apparatus 34 to grip running rail 12 and securely support channel 20 on the bottom of running rail 12. The configuration of bracket 46 assists in ensuring that bolt 38 is oriented perpendicular to plate 48 so that vibration will not cause loosening or slippage of clamp apparatus 34 from running rail 12.

A pair of rollers 56 and 58 are rotatably mounted on a pair of pins 60 and 62 respectively, which are journaled through apertures in side walls 20*a* and 20*b*, inwardly along channel 20 relative to clamp mechanism 34 and running rail 12. Roller 56 is parallel and spaced inwardly along channel 20 relative to roller 58. As shown in FIG. 1, rollers 56 and 58 are located in the side walls 20*b* and 20*c* of channel 20 with an upper horizontal tangent 56*a* and 58*a* respectively, forming a bearing surface located above the upper edges of side walls 20*b* and 20*c*. As shown in FIG. 4, upper bearing surfaces 56*a* and 58*a* will support switch point 18 as it moves towards and away from running rail 12 during a switching operation. Although upper bearing surfaces 56*a* and 58*a* are shown in the same horizontal plane in FIGS. 1 and 4, it should be understood that the relative heights of these bearing surfaces may be stepped such that switch point 18 is raised slightly as it moves from outer roller 58 to inner roller 56.

Pins 60 and 62 are provided with flattened head ends 60*a* and 62*a* which will engage a ledge 64 affixed to side wall 20*c* directly below pins 60 and 62. The engagement of heads 60*a* and 62*a* with ledge 64 prevents rotation of pins 60 and 62 such that the vast majority of wear occurs as rollers 56 and 58 rotate on pins 60 and 62, rather than the frictional rotation between pins 60 and 62 and side walls 20*b* and 20*c*. A pair of cotter pins 66 retain pins 60 and 62 in position on channel 20.

As shown in FIG. 2, adjustment mechanism 32 includes a vertically oriented adjustment plate 68 affixed to the inner end 22 of channel 20 and projecting upwardly therefrom. A vertically oriented slot 70 is formed in plate 68 and receives a bolt 72 therethrough. A second plate 74 is mounted vertically on the adjacent side wall 26*b* of channel 26 and is located for placement in abutting contact with plate 68. A nut 76 is welded to one face of plate 74 adjacent an aperture in plate 74 to receive bolt 72 therethrough. Thus, bolt 72 will fasten the inner end 22 of channel 20 to channel 26. Slot 70 permits vertical adjustment of support member 26 relative to channel 20 prior to tightening of bolt 72 in nut 76.

Referring now to FIG. 4, an arm 78 is mounted to the bottom surface of the inner end of channel 20 and projects inwardly beyond the inner end of channel 20 so as to be juxtaposed under support member 26. The projecting end of arm 78 has an aperture 80 formed therein and a nut 82 affixed to the bottom of arm 78 coaxially with aperture 80, to receive a bolt 84 therein. As shown in FIG. 2, a cross-member 86 is mounted between side walls 26*b* and 26*c* of support member 26 and has an aperture 88 formed therein to receive bolt 84. Base portion 26*a* of support member 26 has an aperture therein (not shown) which will receive bolt 84, and which is coaxial and aligned with aperture 80 and arm 78.

As shown in FIG. 4, bolt 84 extends through cross-member 86 and base portion 26*a* of support member 26 and thence through aperture 80 and arm 78 so as to engage nut 82. Once the forward and rearward ends 28 and 30 of support member 26 are fastened to ties 14 and 16 by bolts 90 (as shown in FIG. 1) bolt 84 is utilized to fine tune the vertical height of inner end 22 of channel 20 relative to switch point 18 and running rail 12.

Figure 3:
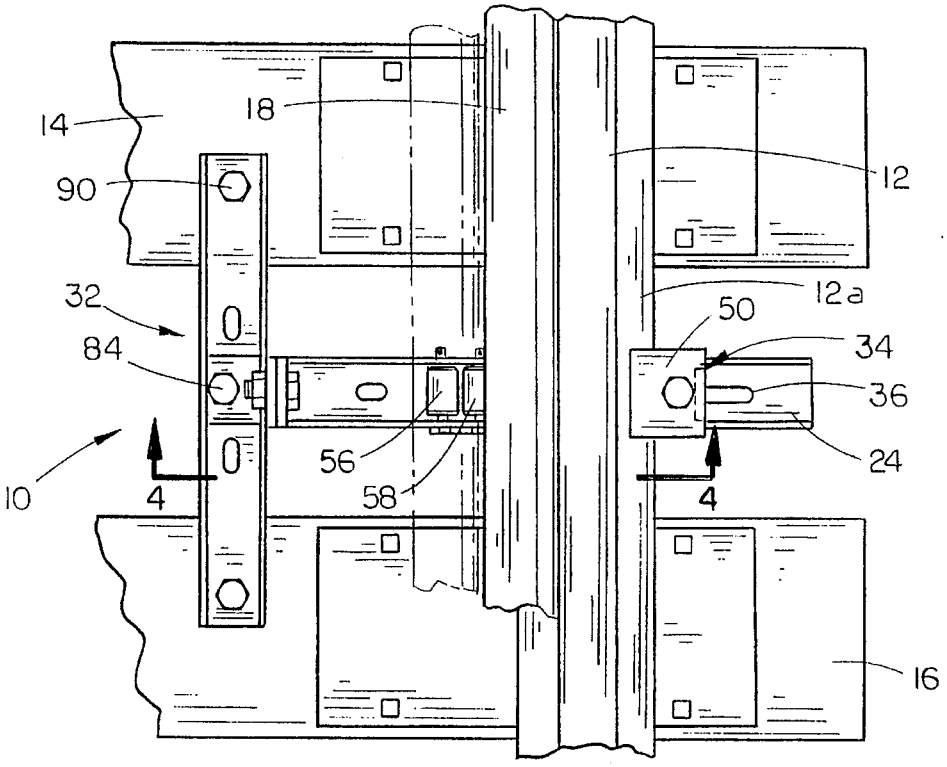
FIG. 3 is a top plan view of the switch point assist apparatus installed on a track.

In use, switch point assist apparatus 10 may be easily inserted under a switch point 18 and running rail 12 between a pair of ties 14 and 16, as shown in FIG. 1. Clamp apparatus 34 is moved along slot 36, as shown in FIGS. 3 and 4 until rollers 56 and 58 are located in the desired transverse position relative to switch point 18. Clamp apparatus 34 is then operated to fasten outer end 24 of channel 20 to running rail 12, by tightening nut 44 on bolt 38.

Once clamp apparatus 34 has been tightened on running rail 12, as shown in FIG. 1, bolts 90 are threaded into ties 14 and 16 to prevent movement of channel 20 along the longitudinal axis of channel 20. Bolt 84 is then adjusted to raise and lower the inner end 22 relative to support member 26, as shown in FIG. 4. Once the desired vertical adjustment is made, bolt 72 is tightened into nut 76 to affix the position of inner end 22 relative to support member 26.

Whereas the invention has been shown and described in connection with the preferred embodiment thereof, it will be understood that many modifications, substitutions and additions may be made which are within the intended broad scope of the appended claims. There has therefore been shown and described an improved switch point assist apparatus which accomplishes at least all of the above stated objects.

We claim:

1. A rail switch point assist apparatus, comprising:

an elongated main member having an inward and an outward end;

means connected to the outward end of said main member for removably, adjustably connecting the main member to a railroad track running rail;

said means for connecting said main member to said running rail including a bracket pivotally and slidably mounted on said main member;

a first generally cylindrical roller rotatably mounted on its rotational axis to said main member, said first roller located intermediate the ends of the main member with its rotational axis oriented generally perpendicularly thereto, said first roller having a roller surface for operably bearing a moving switch point;

an elongated support member connected to the inward end of said main member and oriented generally perpendicular thereto; and means for selectively vertically adjusting said roller relative to the support member.

2. The apparatus of claim 1, wherein said bracket includes a generally vertical leg member having upper and lower ends and a plate member attached to the upper end of the leg member and projecting generally perpendicular therefrom, said bracket mounted on said main member for selective pivotal movement about a pivot axis transverse to the longitudinal axis of said main member and for selective slidable movement of the pivot axis along the longitudinal axis of the main member, the lower end of said leg member forming said pivot axis, and further including means for selectively limiting the pivotal and slidable movement of said bracket.

* * * * *